US005530318A

United States Patent [19]

Ensign, Jr. et al.

[11] Patent Number: 5,530,318

[45] Date of Patent: Jun. 25, 1996

[54] EL LAMP WITH INTEGRAL FUSE AND CONNECTOR

[75] Inventors: Thomas C. Ensign, Jr., Scottsdale; Ramona R. Fechter, Chandler; Rodney T. Eckersley, Tempe, all of Ariz.; Donald H. Savery, Fort Mill, S.C.

[73] Assignee: Durel Corporation, a Delaware Corporation, Chandler, Ariz.

[21] Appl. No.: 448,745

[22] Filed: May 24, 1995

[51] Int. Cl.[6] ..... H05B 33/00

[52] U.S. Cl. ..... 315/74; 315/119; 315/169.3

[58] Field of Search ..... 315/74, 58, 119, 315/120, 124, 225, 362, 169.3; 313/498, 506

[56] References Cited

U.S. PATENT DOCUMENTS 3,109,958 11/1963 Delachapelle et al. ..... 315/74
3,109,959 11/1963 DeLachapelle et al. ..... 315/74
4,208,645 6/1980 Harmon et al. ..... 337/297
4,482,580 11/1984 Emmett et al. ..... 427/66
4,853,594 8/1989 Thomas ..... 313/503

*Primary Examiner*—Robert Pascal
*Assistant Examiner*—David H. Vu
*Attorney, Agent, or Firm*—Cahill, Sutton & Thomas

[57] ABSTRACT

An electroluminescent lamp includes at least one bus bar attached to an electrode of the lamp. The bus bar has a gap and a conductive trace bridges the gap. The trace is preferably an isolated segment of the front electrode of the lamp and is made when the front electrode is patterned. The bus bar includes at least one pair of holes extending through the bus bar. The holes each have a diameter less than the width of the bus bar and are spaced along the length of the bus bar. The segment of the bus bar between the holes can be curved to define a path through the holes adjacent the bus bar. A conductive pin through the holes makes electrical contact with the bus bar and is held in place by the holes and the curved segment. The bus bar is an integral connector and the conductive trace is an integral fuse.

9 Claims, 2 Drawing Sheets

EL LAMP WITH INTEGRAL FUSE AND CONNECTOR

BACKGROUND

This is invention relates to electroluminescent (EL) lamps and, in particular, to an EL lamp having an integral fuse and connector.

An electroluminescent lamp is essentially a capacitor having a dielectric layer between two conductive electrodes, one of which is transparent. The dielectric layer may include a phosphor powder or there may be a separate layer of phosphor powder adjacent the dielectric layer. The term "electroluminescent dielectric layer" is intended to be generic to either construction. The phosphor powder radiates light in the presence of a strong electric field, using very little current. The front electrode is typically a thin, transparent layer of indium tin oxide or indium oxide and the rear electrode is typically a polymer binder, e.g. polyvinylidene fluoride (PVDF), polyester, vinyl, or epoxy, containing conductive particles such as silver or carbon. The front electrode is applied to a polymer substrate, such as polyester or polycarbonate, which provides mechanical integrity and support for the other layers.

In order to produce a sufficiently strong electric field within the phosphor to cause the phosphor to glow brightly, an EL lamp is typically connected to a source of alternating current of 80 volts or more. Although an EL lamp draws very little current, typically one milliampere per square inch of light emitting surface, an EL lamp is often connected to a source of power capable of supplying hundreds or thousands of times as much current, e.g. an AC outlet in a home. It is therefore a problem if an EL lamp becomes damaged because a large current is available for any low resistance path which may be created, e.g., by accidentally puncturing or cutting an EL lamp. A low resistance path may be created that is not sufficient to open a fuse rated at fifteen or twenty amperes but is sufficient to produce a considerable amount of heat.

It is known in the art to combine a fuse with an EL lamp. U.S. Pat. No. 3,109,959 (Delachapelle et al.) discloses an EL lamp having a metal clip connector in which a portion of the clip is narrowed to form a fuse. The fuse is disclosed as having a rating of ten amperes.

Providing a fuse for an EL lamp can significantly affect the cost of the lamp. High amperage fuses, e.g. fuses rated at three amperes or more, are relatively inexpensive. Low amperage fuses are more difficult to make and are more expensive than high amperage fuses. A fuse rated at a few milliamperes or a few tens of milliamperes would cost much more than the EL lamp it was protecting.

A low amperage fuse is disclosed in U.S. Pat. No. 4,208,645 (Harmon et al.) in which conductive ink is screen printed on an oriented plastic substrate. The fuse has two failure modes. For low overcurrent, the substrate melts, separating the conductive trace printed on the substrate. For high overcurrent, a portion of the conductive trace evaporates from the substrate. Although lower in cost than high current fuses, the fuse described in the Harmon et al. patent, like the fuse described in the Delachapelle et al. patent, is a separate component which must be added to the device to be protected.

One type of connector used in the prior art is a staple type of connector having several small blades punched from a conductive sleeve. The blades puncture the lamp and are bent over to secure the connector to the lamp. A connector must be secured to a lamp without destroying the conductive stripe to which contact is made.

Another type of connector used in the prior art is a combination of a pin and an eyelet or grommet. A hole is punched in the lamp and the eyelet is inserted through the hole and crimped into place. The pin is then press fit into the eyelet, completing the connector. This type of connector is more expensive than the sleeve described above.

In many applications for EL lamps, such as the dial lamp in a household clock, cost is a major consideration. The electrical connection to a clock motor is typically made with a ferrule or collar crimped about the wire from a line cord and a terminal within the clock. Some EL lamps used as a dial lamp in clocks include a sleeve type of connection that is crimped to a terminal with a wire from a line cord. Although part of the sleeve is crimped, the puncture of the blades remains the mechanism by which the EL lamp is connected to a source of power and this mechanism is not particularly reliable.

In view of the foregoing, it is therefore an object of the invention to provide an integral fuse for an EL lamp.

Another object of the invention is to provide a fuse which does not increase the cost of the EL lamp to which it is attached.

A further object of the invention is to provide an integral connector for an EL lamp.

Another object of the invention is to provide a connector which does not increase the cost of the EL lamp to which it is attached.

A further object of the invention is to provide a low amperage fuse for an EL lamp.

SUMMARY OF THE INVENTION

The foregoing objects are achieved by the invention in which an electroluminescent lamp includes at least one bus bar attached to an electrode of the lamp. The bus bar has a gap and a conductive trace bridges the gap. The trace is preferably an isolated segment of the front electrode of the lamp and is made when the front electrode is patterned. The bus bar includes at least one pair of holes extending through the bus bar. The holes each have a diameter less than the width of the bus bar and are spaced along the length of the bus bar. The segment of the bus bar between the holes can be curved to define a path through the holes adjacent the bus bar. A conductive pin through the holes makes electrical contact with the bus bar and is held in place by the holes and the curved segment. The bus bar is an integral connector and the conductive trace is an integral fuse.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
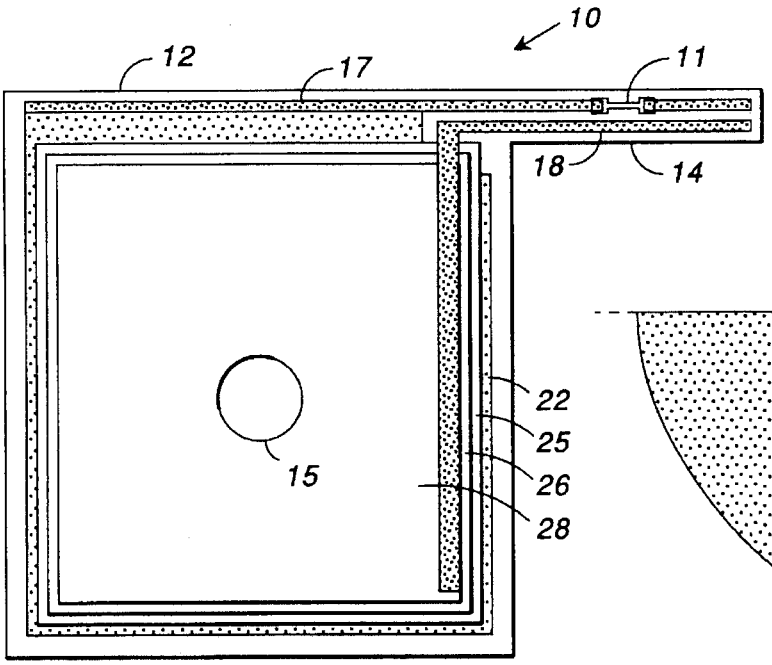
FIG. 1 illustrates an EL lamp constructed in accordance with the invention.

FIG. 1 illustrates an EL lamp such as might be used for backlighting the dial in a clock. Lamp 10 includes fuse 11 as an integral part thereof, i.e. the fuse is formed on the same substrate as the lamp. Substrate 12 includes a rectangular portion and elongated extension 14 attached at one corner of the rectangle. Hole 15 is located approximately centrally in the rectangle to provide clearance for the concentric shafts to which the hands of a clock are attached. Separate, parallel, leads or bus bars 17 and 18 are screen printed along extension 14 and bus bar 17 includes fuse 11 bridging a gap in the bus bar. Fuse 11 is preferably an isolated portion of the transparent conductive layer and has a predetermined width that determines the current carrying capability of the fuse. A voltage is applied to lamp 10 by connecting bus bars 17 and 18 to a suitable source, not shown, of alternating current.

Figure 2:
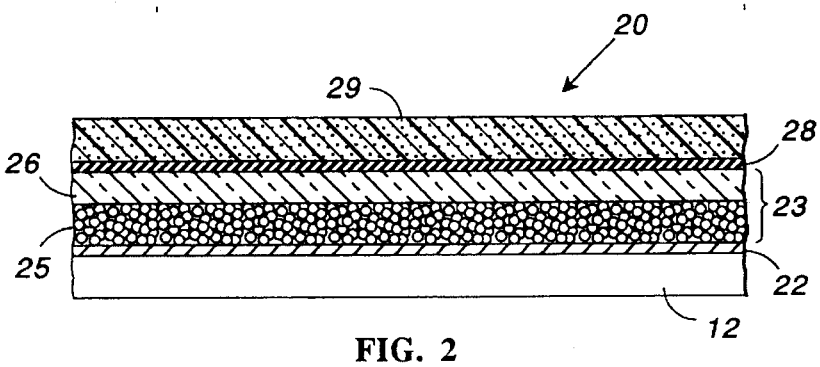
FIG. 2 is a cross-section of an EL lamp.

The construction of lamp 10 may be better understood by considering FIG. 2, which illustrates an EL lamp in cross-section but not to scale. In accordance with a preferred embodiment of the invention, an EL lamp is provided with an integral fuse and an integral connector without adding any process steps or changing the materials from which the lamp is made. Changes could be made to the manufacturing process or to the materials and still provide an integral fuse or an integral connector in accordance with the invention.

In FIG. 2, EL lamp 10 includes transparent substrate 12 of polyester or polycarbonate material having a thickness of about 7 mils (0.178 mm.). Transparent or front electrode 22 overlies substrate 12 and is a layer of indium tin oxide (ITO) or indium oxide. Sheets of material coated on one side with ITO are commercially available from a number of vendors. The ITO is typically vacuum sputtered onto a substrate and has a thickness of 1000 Å or so. The front electrode is patterned to define the active area of the lamp, i.e., the front electrode is removed from substrate 12 in the areas which are to remain unlit. The front electrode is patterned, for example, by chemical etching or by laser etching.

Electroluminescent dielectric layer 23 includes phosphor layer 25 and dielectric layer 26. These layers are staggered in FIG. 1 for clarity but are usually congruent in an actual EL lamp. Phosphor layer 25 typically includes zinc sulfide, doped with copper or manganese, in a polymeric binder and is screen printed over electrode 22 to a thickness of about one mil (0.025 mm.). Dielectric layer 26 is screen printed over phosphor layer 25 to a thickness of 0.75 mils (0.018 mm.). Rear electrode 28 is screen printed over dielectric layer 26 to a thickness of about 0.5 mil (0.013 mm.) and is typically a polymer binder, e.g. polyvinylidene fluoride (PVDF), polyester, vinyl, or epoxy, containing conductive particles such as silver or carbon. Layer 29 is an insulating layer sometimes added over the rear electrode and is typically applied by screen printing. A polymer frequently used in EL lamps is (PVDF). Other materials have been used instead of PVDF.

Figure 3:
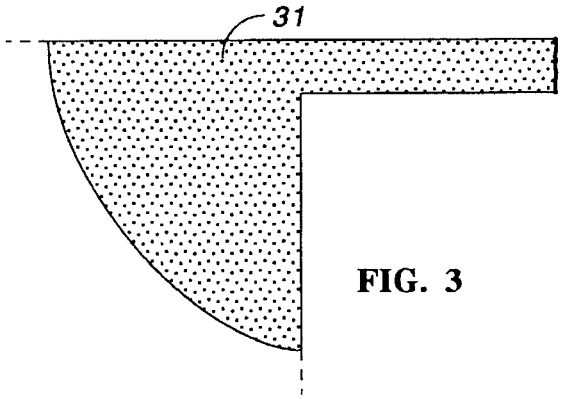
FIG. 3 is a plan view of a portion of an ITO coated substrate for an EL lamp.
Figure 4:
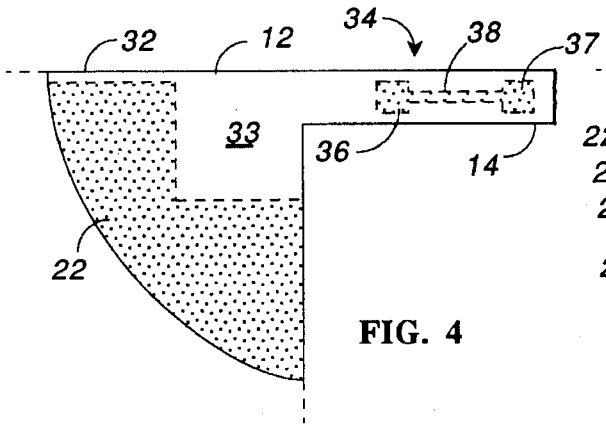
FIG. 4 illustrates the substrate of FIG. 3, patterned to include an integral fuse.

In accordance with the invention, a fuse is incorporated into an EL lamp as follows. FIG. 3 is a plan view of a substrate covered by a transparent, conductive layer, represented by stippled area 31. The layer is patterned to define the active area of the lamp, as illustrated in FIG. 4, wherein the conductive layer is removed from edge 32, corner 33, and from some of extension 14, leaving front electrode 22 and fuse 34. Corner 33 is removed to provide clearance for bus bar 18 (FIG. 1), i.e. to prevent bus bar 18 from shorting to front electrode 22.

The conductive layer is patterned to leave a dumbbell or dogbone shaped fuse on extension 14. Fuse 34 preferably includes enlarged end portions 36 and 37 interconnected by conductive trace 38. The enlarged end portions provide contact areas for connection to a bus bar that is screen printed with a conductive ink. The size of the end portions simplifies registration of a bus bar with the conductive trace. The width of conductive trace 38 determines the current carrying capability of fuse 34.

As an example of a fuse constructed in accordance with the invention, two lamps, each having a lit area of approximately ten square inches and drawing approximately 1.6 milliamperes at 120 volts and 60 hz., were provided with an integral fuse in the front electrode. In a first lamp, conductive trace 38 had a length of 0.190 inches (4.8 mm.) and a width of 0.030 inches (0.76 mm.) and failed at a current of 6.4 milliamperes or an overcurrent of four hundred percent. In the second lamp, conductive trace 38 had a length of 0.190 inches (4.8 mm.) and a width of 0.040 inches (1 mm.) and failed at a current of 24.0 milliamperes or an overcurrent of fifteen hundred percent. Thus, the integral fuse protected the EL lamp from dissipating currents large enough to be destructive yet not large enough to trip typical household fuses.

Figure 5:
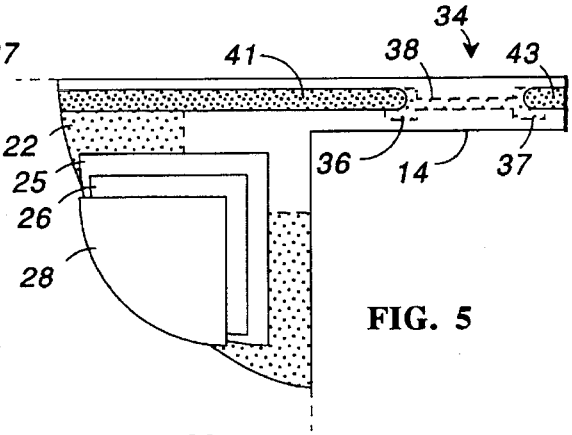
FIG. 5 is a plan view of a portion of an EL lamp including bus bars.

As illustrated in FIG. 5, after the conductive layer is patterned, phosphor layer 25, dielectric layer 26, and the rear electrode are consecutively screen printed over the front electrode. Bus bars 17 and 18 (FIG. 1) are then screen printed, making contact to front electrode 22 and to rear electrode 28. Bus bar 17 is screen printed in two sections with the gap between the sections bridged by fuse 34. Section 41 of bus bar 17 overlies a portion of front electrode 22 and provides contact along the upper edge of the front electrode. One end of section 41 contacts enlarged end portion 36 of fuse 34. Section 43 of bus bar 17 contacts enlarged end portion 37 of fuse 34. Thus, in accordance with one aspect of the invention, an integral fuse is provided without adding any process steps or changing any materials in the manufacture of an EL lamp. The pattern in the transparent, conductive layer is modified to include an isolated trace which serves as a fuse.

Figure 6:
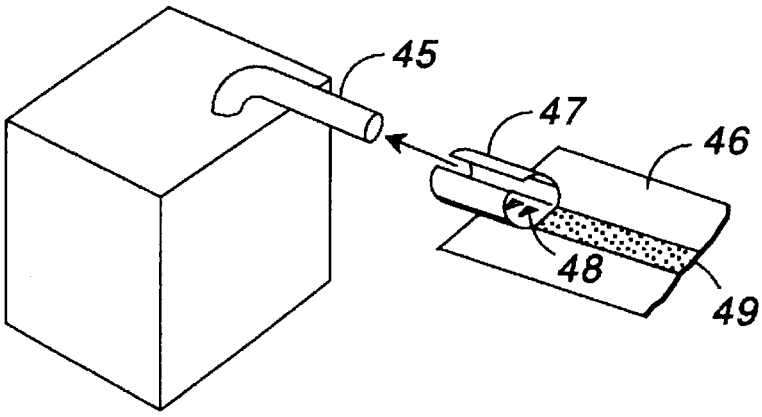
FIG. 6 (PRIOR ART)
FIG. 6 illustrates a connection in accordance with the prior art.

In accordance with another aspect of the invention, an integral connector is provided without changing the process steps or materials for making an EL lamp. FIG. 6 illustrates a connector as used in clocks having a dial backlit by an EL lamp. Terminal 45 provides an electrical connection to a motor (not shown) in a clock. EL lamp 46 includes sleeve 47 attached to lamp 46 by darts or blades, such as dart 48 which punctures lamp 46 and makes contact to bus bar 49. Terminal 45 is inserted into sleeve 47 and the sleeve is crimped to provide a mechanical joint.

Figure 7:
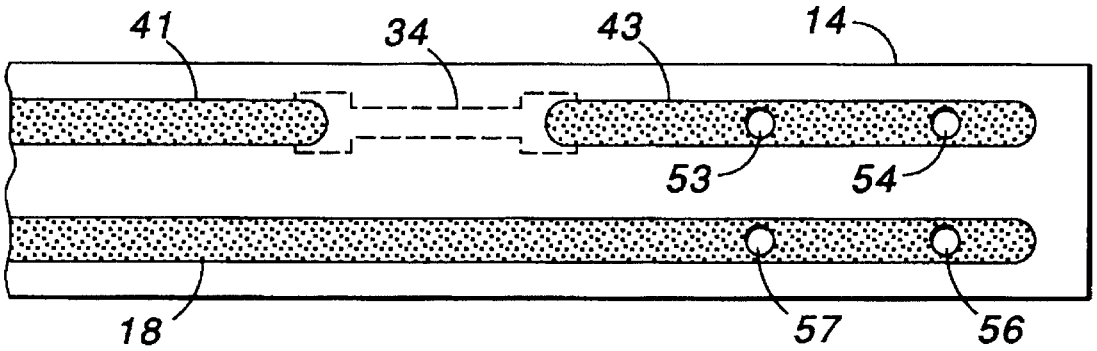
FIG. 7 illustrates an EL lamp including an integral connector.

FIG. 7 illustrates a connector constructed in accordance with a preferred embodiment of the invention in which holes 53 and 54 are located along the length of section 43 and holes 56 and 57 are located along the length of bus bar 18. These holes are formed at the same time as hole 15 (FIG. 1) or are made when lamp 10 is cut from a sheet of substrate material. The holes extend through the substrate of the lamp and have a diameter slightly smaller than the width of the bus bars.

Figure 8:
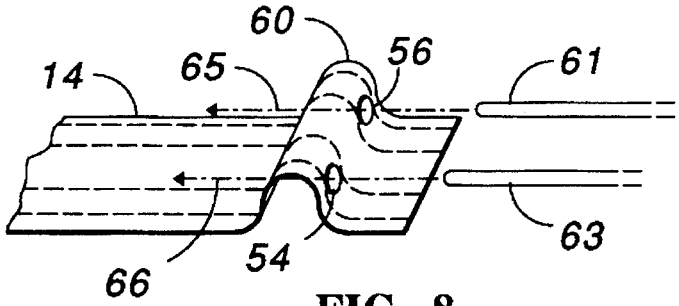
FIG. 8 illustrates making a connection to an EL lamp constructed in accordance with the invention.

FIG. 8 illustrates the operation of the connector in which the bus bars are on the underside of extension 14. Extension 14 is bowed or curved in the region between holes 53 and 54 (FIG. 7) to create wave 60 and to define a path through the holes and adjacent the bus bars. Terminal pins 61 and 63 are inserted through holes 54 and 56, as indicated by arrows 65 and 66, putting the bus bars on the underside of extension 14 and in contact with the pins along the segments of the bus bars between the holes. The pins exit holes 53 and 57 (not shown in FIG. 8), passing over, under, then over extension 14 in a weaving action which secures extension 14 to the pins.

Although extension 14 is curved, the extension is not deformed and seeks to straighten out. The restoring force provided by extension 14 pushes the bus bars into contact with pins 61 and 63 and also presses the upper side of extension 14 into contact with the pins. This frictional engagement provides both a mechanical and an electrical connection between extension 14 and pins 61 and 63. If desired, a collar or ferrule could be placed around the pins and crimped into place to further secure extension 14 to the pins.

The invention thus provides a mechanical and electrical connection without adding any process steps or change in materials to the manufacture of an EL lamp. Having thus described the invention, it will be apparent to those of skill in the art that various modifications can be made within the scope of the invention. For example, the number of holes in the extension can be increased, increasing the number of waves and increasing the amount of contact between extension 14 and terminal pins 61 and 63. Although illustrated in FIG. 8 as being inserted from the free end of extension 14, pins 61 and 63 can be inserted from the opposite direction. Extension 14 is illustrated as attached to the lamp along the entire upper edge of the lamp. Extension 14 could also be separated from a substantial fraction of the upper edge by a cut in the substrate. This would increase the length of extension 14 without increasing the overall dimensions of the lamp. A fuse need not be in line with a bus bar. For example, section 41 could be parallel to section 43 and fuse 34 could extend between the two sections. The fuse need not be located in extension 14 but could be located elsewhere in the lamp. A fuse could be made at the same time that a conductive layer is being screen printed, e.g. by printing a constriction in a bus bar, but this fuse would have a high rating than the ITO fuse. A screen printed fuse could be thinner rather than narrower than adjoining material or could be both thinner and narrower to minimize the rating of the fuse.

What is claimed as the invention is:

1. An electroluminescent lamp having an integral fuse and an integral connector, said lamp comprising:

a flexible substrate;

a transparent, conductive layer on said substrate;

at least one bus bar on said substrate and electrically coupled to said conductive layer, said bus bar having a gap;

a conductive trace overlying said substrate and bridging said gap;

said bus bar having a width and a length and including at least one pair of holes extending through said bus bar and through said substrate, wherein said holes each have a diameter less than said width and are separated along said length;

an electroluminescent dielectric layer overlying a portion of said transparent, conductive layer; and a rear electrode overlying said electroluminescent dielectric layer;

wherein said holes and a segment of the bus bar between said holes form said integral connector and wherein said trace is said integral fuse.

2. The electroluminescent lamp as set forth in claim 1 wherein said fuse is located between said portion and said holes.

3. The electroluminescent lamp as set forth in claim 1 wherein said trace is the same material as said conductive layer.

4. The electroluminescent lamp as set forth in claim 1 wherein said conductive trace includes enlarged end portions for contact with said bus bar.

5. An electroluminescent lamp having an integral fuse, said lamp comprising:

a substrate;

a transparent, conductive layer on said substrate;

at least one bus bar on said substrate and electrically coupled to said conductive layer, said bus bar having a gap;

a conductive trace overlying said substrate and bridging said gap;

an electroluminescent dielectric layer overlying a portion of said transparent, conductive layer; and a rear electrode overlying said electroluminescent dielectric layer.

6. The electroluminescent lamp as set forth in claim 5 wherein said trace is the same material as said conductive layer.

7. The electroluminescent lamp as set forth in claim 5 wherein said conductive trace includes enlarged end portions for contact with said bus bar.

8. An electroluminescent lamp having an integral connector, said lamp comprising:

a substrate;

a transparent electrode overlying said substrate;

at least one bus bar overlying said substrate and electrically coupled to said transparent electrode, said bus bar having a width and a length and including at least one pair of holes extending through said bus bar and through said substrate, wherein said holes each have a diameter less than said width and are separated along said length;

an electroluminescent dielectric layer overlying said transparent electrode;

a rear electrode overlying said electroluminescent dielectric layer;

wherein said holes and a segment of the bus bar between said holes form said integral connector.

9. The electroluminescent lamp as set forth in claim 8 wherein said substrate is flexible and can be bent along the length of said bus bar to define a path between said holes adjacent said bus bar.

* * * * *